US005541710A

United States Patent [19]

Stewart et al.

[11] Patent Number: 5,541,710

[45] Date of Patent: Jul. 30, 1996

[54] BEARING SEAL FOR XEROGRAPHIC DEVELOPER UNIT

[75] Inventors: Daniel A. Stewart, Savage; Paul A. Martinson, White Bear Lake, both of Minn.

[73] Assignee: Katun Corporation, Minneapolis, Minn.

[21] Appl. No.: 533,072

[22] Filed: Sep. 25, 1995

[51] Int. Cl.[6] ..... G03G 21/00

[52] U.S. Cl. ..... 355/215; 384/147

[58] Field of Search ..... 355/215, 245; 118/653; 384/147, 148

[56] References Cited

U.S. PATENT DOCUMENTS 5,475,467 12/1995 Watanabe et al. ..... 355/215

OTHER PUBLICATIONS

Mita Technical Bulletin DC–4600, Subject: Preventing Developing Roller Shaft From Wearing, Oct. 26, 1993.

Mita SCOOP, vol. 5–No. 4, Sep.–1989.

*Primary Examiner*—Joan H. Pendegrass

*Assistant Examiner*—Quana Grainger

*Attorney, Agent, or Firm*—Kinney & Lange, P.A.

[57] ABSTRACT

A bearing unit is used to suspend shafts within a developer unit housing of a xerographic device. An annular bushing is used with a bearing surface to support an end journal of the shaft. The bushing also has a seal retention shoulder which extends axially from the bearing surface portion. An annular sealing member is positioned against the seal retention shoulder such that it remains stationary with the annular bushing. The sealing member includes two or more sealing lips for contacting the end journal with a stagnation zone between the sealing lips. The sealing lips are on deflection arms extending toward the interior of the developer unit housing.

16 Claims, 4 Drawing Sheets

BEARING SEAL FOR XEROGRAPHIC DEVELOPER UNIT

BACKGROUND OF THE INVENTION

This invention relates to xerographic developer units, and more particularly to a bearing seal for shafts which project through the housing of a xerographic developer unit.

Xerography and xerographic processes are used in various common reproduction devices. For instance, many presently marketed photocopiers and facsimile machines use xerographic processes in reproducing printed images. These xerographic devices generally include what is known as a developer unit.

The developer unit stores "developer", which is generally a particulate material made up of carrier particles and toner particles. The carrier is most commonly made from magnetite, which may be rough, spherical particles coated with a resin material. The toner is typically a polymer resin which includes a color agent and has a relatively small particle size compared to the carrier particles. The developer unit manipulates the developer so as to transfer toner onto a photoreceptor drum used in printing the reproduced image. The carrier particles actually carry the toner particles for proper application on the photoreceptor drum. However, when the toner is deposited on the photoreceptor drum, the carrier is retained in the developer unit.

Common developer units include a developer sump which is defined by a housing. Because the toner is used by the xerographic process, toner must be constantly replenished into the developer sump. A toner hopper will often be positioned adjacent the developer housing. Rotating paddles on a shaft are used to draw the toner out of the toner dispensing mechanism or toner hopper into the developer sump. To have the developer work properly, it is often desired that the toner and carrier particles be constantly stirred in the developer sump. This stirring is typically performed by an auger assembly on a second shaft which extends through the developer housing. A third shaft may also extend through the developer housing to support a magnetic roller which applies the developer to the photoreceptor drum.

It is generally desired to drive the paddle assembly, auger assembly and magnetic roller shafts with a motor located outside the developer housing. The ends of the shafts typically extend through the walls of the developer housing and end in a series of gears for connection to the motor.

For a xerographic device to work properly for an extended period of time, the developer unit housing must effectively seal the developer within the developer unit. Leakage of developer from the developer unit will adversely affect the performance of parts outside the developer housing and can result in failure of the xerographic device. For instance, the carrier particles are extremely abrasive. Leakage of carrier can cause wear of critical parts—including the developer unit drive train and parts within the paper feed section—which ultimately can lead to catastrophic failure of the xerographic device. Leakage of toner tends to create a mess within the xerographic device, and can accumulate on paper or other media being fed through the xerographic device as well as on the remaining elements within the xerographic device.

Accordingly, it is desired to have the shafts for the paddle assembly, auger assembly and magnetic roller extend through the developer housing but have a bearing and seal system for these shafts which will completely retain the developer within the developer unit housing. Typically, end journals of developer unit shafts are supported by stationary bushings with a bearing surface which supports the rotating shaft. Except for the portion of each end journal that fits into a bushing and the portion that protrudes outside the developer unit housing, the assemblies and seals are completely submerged in developer during unit operation. Leakage of developer into the contact area between the bushings and the shaft will cause wear of the shaft and/or bushing bearing surface, which will in turn accelerate leakage of developer from the developer unit. Consequently, it is crucial that the sealing system maintain constant contact to prevent developer from immediately falling into the critical interface between the bearings and end journals. Adequate sealing is most important on the geared end of the shafts, where the additional rotary force and stress the drive train places on the shafts causes seals to fail earlier and more frequently.

Various bushing and seal systems have been used to retain developer within the developer housing. For instance, in some photocopiers, a V-ring type seal is mounted on the shaft such that it rotates with the end journal of the shaft and bears against a radially extending inner face of the bushing. Other seal assemblies have existed which use a single stationary seal bearing against a rotating shaft. However, these previous systems have failed to perform effectively, and generally need to be replaced at intervals of 100,000 to 500,000 copy counts. If this suggested maintenance is not done, the seal/bearing assembly may fail, leading to leakage of developer and the aforementioned problems. Occasionally, failure of the seal may occur prior to the suggested maintenance limits, again causing serious problems which would be avoided by a better sealing system.

In response to developer leakage problems, polytetrafluoroethylene (PTFE) coatings have been applied to bushings and seals. These coatings are intended to allow the non-lubricated V-rings to rotate more smoothly against the bushing, thereby improving their seal and reducing wear. Various spacing systems have been utilized to more accurately position the seals against the bushings. Precise machining of the end journals of the shaft has been used to lessen any gap between the end journals and the bushings. While these lubrication coatings, spacers and machining have been helpful in extending seal life, leakage of developer remains a problem, and has occurred at copy counts as low as 100,000 copies. Additionally, some of the spacing systems require the service technician/engineer to determine exactly how many spacers to use, introducing human error as affecting seal effectiveness.

SUMMARY OF THE INVENTION

The present invention is a bearing system for use to suspend shafts within the developer unit housing. An annular bushing is used with a bearing surface to support an end journal of the shaft. The bushing also has a seal retention shoulder which extends axially from the bearing surface portion. An annular seal is positioned against the seal retention shoulder such that it remains stationary with the annular bushing. The seal includes two or more sealing lips for contacting the outer diameter of the shaft. The two sealing lips define a stagnation zone between the sealing lips. The present invention also contemplates a modification kit for retrofitting current xerographic devices with the bearing unit. The modification kit may include an auger assembly and a paddle assembly in addition to the bearing units for these assemblies.

DETAILED DESCRIPTION OF THE PREFERRED EMBODIMENTS

Figure 1:
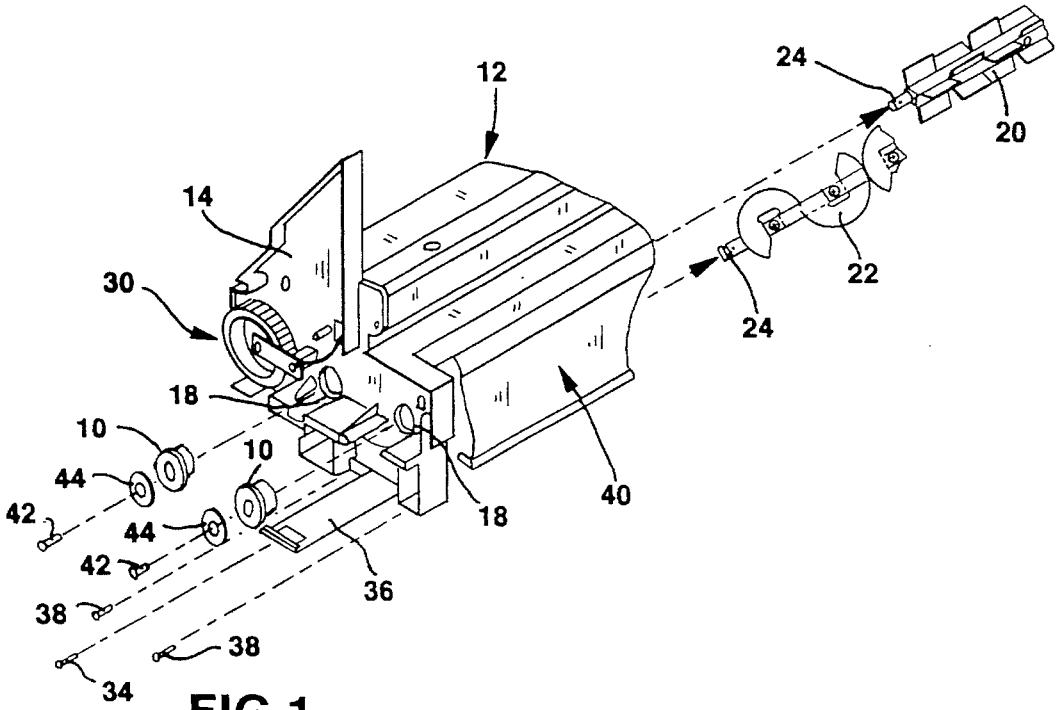
FIG. 1 is an exploded perspective view of a front portion of a developer unit utilizing the present invention.
Figure 2:
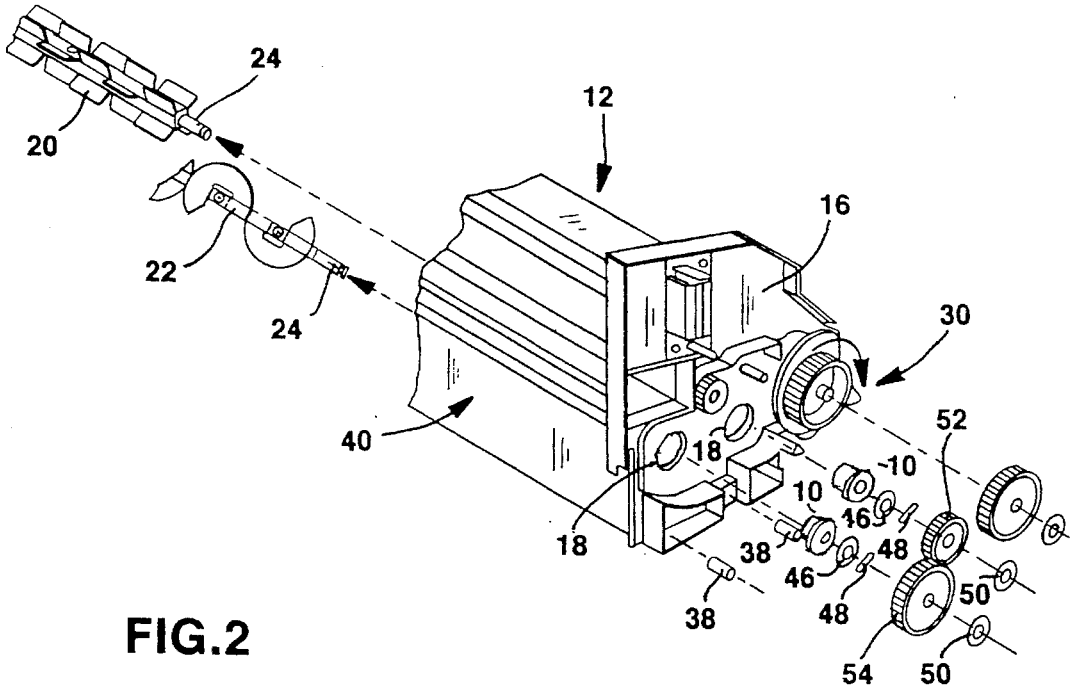
FIG. 2 is an exploded perspective view of a back portion of a developer unit utitilizing the present invention.

FIGS. 1 and 2 illustrate use of four bearing units 10 of the present invention with a developer unit 12. As shown, bearing units 10 can be used both on the front housing wall 14 and the rear housing wall 16. Bearing units 10 are inserted into apertures 18 in housing walls 14, 16 to support the shafts of paddle assembly 20 and auger assembly 22. Paddle assembly 20 and auger assembly 22 include end journals 24 on both ends.

Magnetic roller 30 is also located within developer unit 12. A modification kit to retrofit developer unit 12 with the present invention may include four bearing units 10, a paddle assembly 20, an auger assembly 22 and necessary attachment components. Alternatively, a modification kit may also include bearing units 10 for magnetic roller 30.

Various attachment components may be used for disassembly and assembly of developer unit 12. Screw 34 holds slide cover 36 to the bottom of developer unit 12. Chassis screws 38 hold housing walls 14, 16 to the main body section 40 of developer unit 12. As shown in FIG. 1, screws 42 and spacers 44 may be used to retain end journals 24 within bearings 10. As shown in FIG. 2, spacers 46, drive pins 48 and e-clips 50 may be used to attach gears 52, 54 to end journals 24 and to retain end journals 24 within bearings 10. Workers skilled in the art will appreciate that numerous other attachment components may be used as appropriate in any particular developer unit 12.

Figure 3:
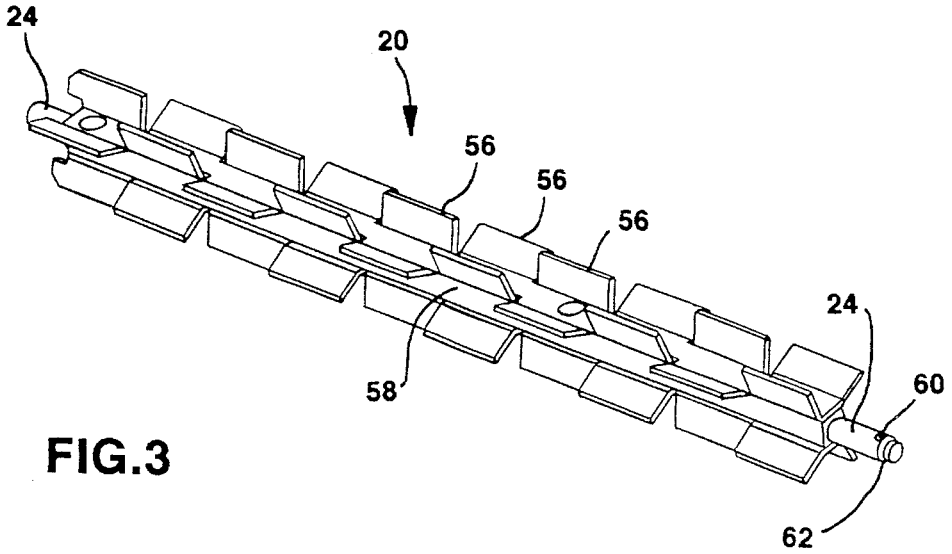
FIG. 3 is a perspective view of a paddle assembly partially shown in FIGS. 1 and 2.
Figure 4:
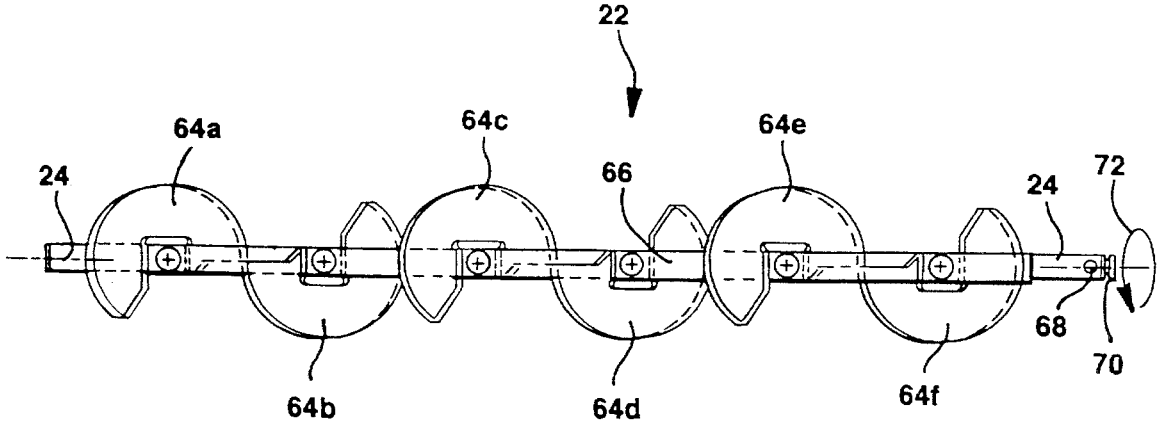
FIG. 4 is an elevational view of an auger assembly partially shown in FIGS. 1 and 2.

FIGS. 3 and 4 illustrate a typical paddle assembly 20 and a typical auger assembly 22 for use with the present invention. Paddle assembly 20 includes a plurality of paddles 56 extending from shaft 58. The ends of shaft 58 are machined or otherwise formed into end journals 24. One end of shaft 58 may further have a hole 60 and a groove 62. Hole 60 and groove 62 facilitate attachment to gear 52 (shown in FIG. 2) to rotationally drive the paddle assembly 20. Paddle assembly 20 is typically positioned in the developer unit 12 adjacent a toner cartridge or hopper, such that rotation of paddle assembly 20 will draw toner material from the toner hopper into the developer sump or mixing chamber.

Auger assembly 22 includes a plurality of blades 64*a*, 64*b*, 64*c*, 64*d*, 64*e* and 64*f* extending from shaft 66. The ends of shaft 66 are machined or otherwise formed into end journals 24. One end of shaft 66 may further have a hole 68 and a groove 70. Hole 68 and groove 70 facilitate attachment to gear 54 (shown in FIG. 2) to rotationally drive the auger assembly 22.

Auger assembly 22 is typically positioned in the developer unit 12 within the developer sump or mixing chamber. Each of the auger blades 64*a*, 64*b*, 64*c*, 64*d*, 64*e* and 64*f* extend for approximately 225 degrees around the shaft 66, and are attached to shaft 66 at an angle. Auger blades 64*a*, 64*c* and 64*e* are attached to shalt 66 such that they extend in one general direction (upward as shown). Auger blades 64*b*, 64*d* and 64*f* are attached to shaft 66 such that they extend in an opposite general direction (downward as shown). As auger assembly 22 is rotated in the direction shown by arrow 72 (down in front and up in back), blades 64*a*, 64*c* and 64*e* push material generally to the right, while blades 64*b*, 64*d* and 64*f* push material generally to the left. Therefore, as auger assembly 22 is rotated within developer material, developer material at any given location is thrown from left to right and back again by blades 64*a–f*. In this way carrier particles and toner particles are continually mixed by rotation of auger assembly 22.

The paddle shalt 58 and the auger shaft 66 are preferably made from a nonmagnetic stainless steel. Use of nonmagnetic stainless steel helps to prevent developer from adhering to and building up on the shafts 58, 66 due to magnetic forces between the developer particles and the shafts 58, 66.

The bearing unit 10 of the present invention is shown in FIGS. 5–8. Bearing unit 10 includes a bushing 74 and a seal member 76. Bearing unit 10 is positioned in a housing wall 78 of the developer unit 12 so as to support end journal 24. End journal 24 can be any of the end journals 24 for paddle assembly 20 and auger assembly 22 shown in FIGS. 1 and 2, as well as an end journal for the magnetic roller assembly 30. Housing wall 78 can represent either front housing wall 14 or rear housing wall 16 of developer unit 12 providing an aperture 18.

Bushing 74 is generally annularly shaped and defines an axis 82. Bushing 74 includes a seal retention shoulder 84, a housing insertion shoulder 86, and a bearing surface 88. Seal retention shoulder 84 extends axially and holds seal member 76 in place. Friction between seal retention shoulder 84 and seal member 76 may hold seal member 76 from rotation with end journal 24. Alternatively, adhesive or other attachment methods may be used to hold seal member 76 from rotation with end journal 24. Seal retention shoulder 84 has a larger inner diameter than bearing surface 88. This allows placement of seal member 76 against the same outer diameter of end journal 24 as bearing surface 88. The entry 90 to the seal retention shoulder 84 may be slightly angled or widened to facilitate insertion of seal member 76 into bushing 74 during assembly.

Housing insertion shoulder 86 positions bushing 74 within an aperture 18 of developer unit housing 56. In use, bushing 74 in inserted into the aperture 18 until the wall of housing 56 abuts housing insertion shoulder 86. Bushing 74 may be retained in aperture 18 by adhesive or other attachment methods. Preferably, housing insertion shoulder 86 includes a tab 92 which prevents bushing 74 from rotating in aperture 18. Tab 92 may be fabricated by drilling a hole through a portion of housing insertion shoulder 86 and inserting a tab 92 into the hole.

Bearing surface 88 is the inside surface of bushing 74 which bears against and supports end journal 24. A polished or smooth finish on bearing surface 88 such as a microfinish may be provided to reduce friction between bearing surface 88 and end journal 24 during rotation. Similarly, a polished or smooth finish on end journal 24 such as a microfinish may be provided to reduce friction.

Bushing 74 should be dimensioned as necessary for proper support and positioning of end journal 24 and seal member 76. For example, bearing surface 88 may extend axially for 6 millimeters and may have an 8 millimeter inner diameter to match the outer diameter of end journal 24. The seal retention shoulder 84 may extend axially for 6½ millimeters with an inside diameter of about 12 millimeters.

Bushing 74 is preferably machined from SAE 841 sintered bronze which has been impregnated with oil. After fabrication, bushing 74 should be centrifuged to remove excess oil.

Seal member 76 may be made up of two separate seals 94, 96. Regardless of whether seal member 76 is two separate units or a single unit, seal member 76 includes an inner sealing lip 98 and an outer sealing lip 100. An annular air pocket or stagnation zone 102 is defined around the end journal 24 between the inner sealing lip 98 and the outer sealing lip 100.

Figure 8:
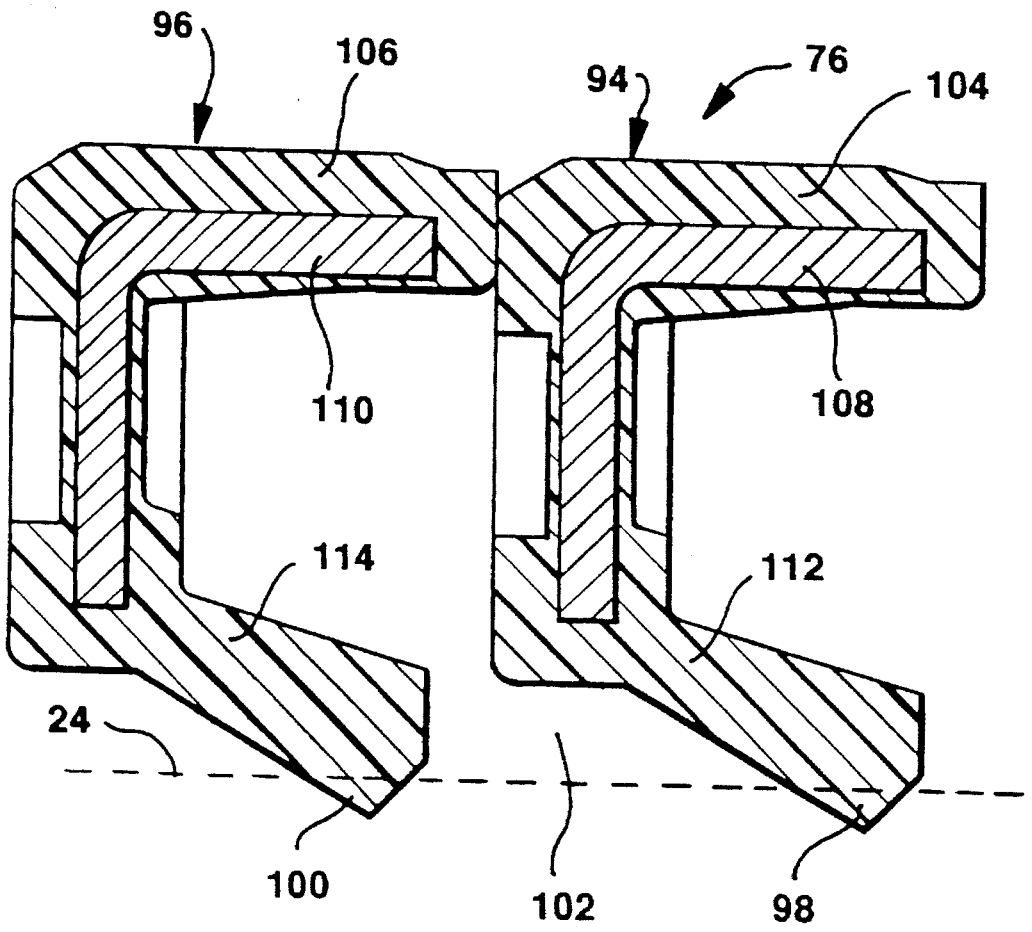
FIG. 8 is an enlarged cross-sectional view of the seal member of the present invention shown in FIG. 5.

Construction of seal member 76 is best shown in FIG. 8. Each seal 94, 96 includes an outside shoulder 104, 106, a metal hoop 108, 110, and a deflection arm 112, 114 with the seal contact portion or sealing lip 98, 100. Other than metal hoops 108, 110, seal member 76 is preferably made from a resilient polymer material such as Nitrile. The resilient polymer material is preferably impregnated with molybdenum disulfide (Moly-D), a lubricant that reduces susceptibility to premature wear of seal member 76. Metal hoops 108, 110 provide strength and rigidity to the seal member 76.

Deflection arms 112, 114 extend axially to place sealing lips 98, 100 in an interference position with end journal 24 (designated by dashed line). When end journal 24 is placed into seal member 76, resilient bending of deflection arms 112, 114 creates a sealing force holding sealing lips 98, 100 in contact with the surface of end journal 24. This sealing force continues due to resilience of deflection arms 112, 114 unless and until sealing lips 98, 100 have worn away to the point that interference between sealing lips 98, 100 and end journal 24 no longer occurs.

It is believed that one of the difficulties of sealing developer within the developer unit housing is the movement of the developer particles. The developer particles are mixed such that they have an axial movement caused by the auger blades 64*a*–64*f* pushing the developer back and forth in the developer unit housing. The developer particles also have a radial movement through rotation of the auger shaft 66 and the paddle shaft 56. It is believed that the combination of this axial and radial movement as the developer continually impinges the seal contributes to difficulties in maintaining seal integrity.

The present invention addresses problems associated with the axial and radial movement of the developer in several ways. First, stagnation zone 102 helps to reduce or eliminate any axial movement or pressure of developer on the seal member 76 and particularly on the critical contact between the sealing lip 100 and the end journal 24. By reducing or eliminating the axial component of the developer motion adjacent the seal member 76, there is less change of axial migration of developer past the seal member 76, and seal life is significantly extended.

Second, the critical contact between the sealing lips 98, 100 and end journal 24 is not dependant on axial placement or movement of shafts 58, 66. During assembly of the developer unit 12, paddle assembly 20 and auger assembly 22 must be placed relative to housing 78. Also, slight variances in the length of shafts 58, 66 may occur when the shafts 58, 66 are machined and slight variances may occur in the overall length of the developer unit 12. The seal of the present invention maintains integrity regardless of axial placement errors or axial variances. Some axial movement of the shafts 58, 66 inevitably occurs during use, particularly on the auger assembly 22 during rotation as it pushes developer material back and forth. The seal of the present invention maintains integrity regardless of axial motion of end journal 24 relative to seal member 76.

Figure 5:
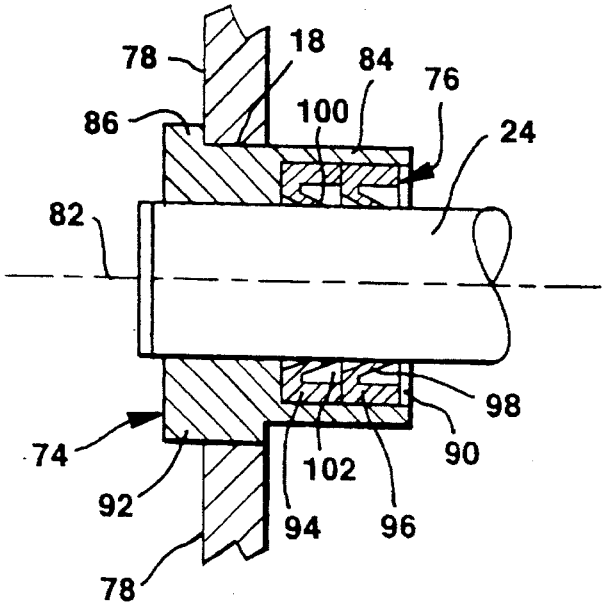
FIG. 5 is a cross-sectional view of the bearing unit of the present invention shown in FIG. 1.
Figure 6:
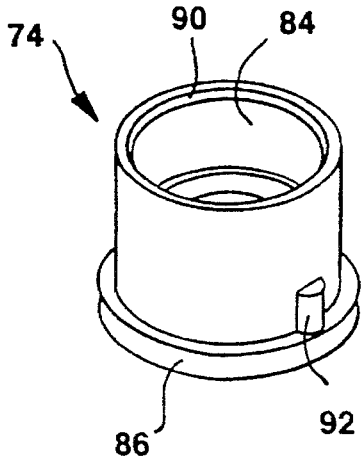
FIG. 6 is a perspective view of the bushing of FIG. 5.
Figure 7:
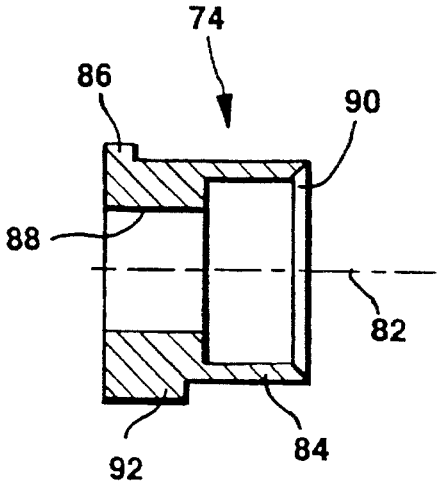
FIG. 7 is a cross-sectional view of the bushing of FIG. 6.

Third, as shown in FIG. 5, deflection arms 112, 114 are oriented to extend from the exterior side of developer unit housing 78 toward the mixing chamber filled with developer. With this orientation, axial pressure from the developer will tend to more firmly set the sealing lips 98, 100 against the end journal 24.

Fourth, the non-magnetic shafts 58, 66 and end journals 24 help avoid additional wear problems. Prior magnetic stainless steel shafts tended to attract developer particles—which are also magnetic—the areas adjacent to the seal interface. The non-magnetic shafts 58, 66 and end journals 24 are more likely to slide through the developer particles without carrying developer particles with them and without forcing abrasive developer to grate against the sealing lips 98, 100.

Fifth, human error associated with assembly is largely eliminated. There is no decision making process associated with a service technician/engineer selecting location of the bearing unit 10 or the paddle assembly 20 and auger assembly 22. There are no service technician/engineer errors which can occur in attempting to position bearing unit 10, paddle assembly 20 and auger assembly 22 in the location selected. Similarly, bearing unit 10 is properly assembled merely by inserting seal member 76 as far as it will go into bushing 74, and the possibility of mis-assembly is minimal.

Sixth, the present invention can be easily retrofitted into current xerographic devices. The invention may be made, used or sold either as a bearing unit by itself or as a modification kit including the bearing unit. Installing the modification kit helps reduce unscheduled service calls between preventive maintenance intervals and significantly reduces distributor/dealer cost-per-copy service expenses. Machine downtime is also significantly reduced, increasing end user customer satisfaction.

Although the present invention has been described with reference to a preferred embodiment, other embodiments of the present invention are also contemplated, some of which are noted in the discussion. In all cases, this disclosure presents illustrated embodiments of the present invention by way of representation and not limitation. Numerous other embodiments and changes in form and detail can be devised by those skilled in the art which fall within the scope and spirit of the principles of this invention. For instance, workers skilled in the art will appreciate that the exterior shape of bushing 74 and seal member 76 need not be circular or cylindrical. The sole requirement for these exterior shapes is that the exterior shape of seal member 76 match against seal retention shoulder 84, and the exterior shape of bushing 74 match against the aperture 18 in developer unit housing 78. Workers skilled in the art will appreciate that there are numerous ways to fabricate workable bushings and seal members other than the methods suggested herein. While the present invention is described with primary reference to paddle assemblies, auger assemblies and magnetic rollers, the bearing unit 10 may have equal utility for shafts of other components used in the developer unit 12.

What is claimed is:

1. A bearing for use to suspend a shaft within a developer housing in a xerographic device, the bearing comprising:

an annular bushing defining a shaft axis, the bushing having a bearing surface having an inner diameter sized to fit an outer diameter of the shaft, the bushing having an outer periphery sized to fit an aperture in the developer housing, the bushing having a seal retention shoulder extending axially from the bearing surface; and an annular seal positioned against the seal retention shoulder of the bushing and retained stationary with respect to the bushing by the seal retention shoulder, the seal having a plurality of sealing lips for contacting the outer diameter of the shaft and defining a stagnation zone between the sealing lips.

2. The bearing of claim 1 wherein the seal comprises:

a first annular seal providing a first sealing lip, and a second annular seal providing a second sealing lip.

3. The bearing of claim 1 wherein the seal is of a resilient shape retaining material, wherein the seal comprises:

axially extending portions supporting each of the sealing lips and defining deflection zones radially outward from each of the sealing lips, such that the amount of force pressing each of the sealing lips to the shaft is dependant on the amount of deflection of the sealing lips into the deflection zone.

4. The bearing of claim 3 wherein one of the deflection zones is open to the interior of the developer housing.

5. The bearing of claim 1 wherein the seal retention shoulder is cylindrical, having a larger inner diameter than the inner diameter of the bearing surface.

6. The bearing of claim 1 wherein the seal comprises:

an annular support ring of metal; and a seal contact surface of polymeric material.

7. The bearing of claim 6 wherein the seal contact surface is of nitrile impregnated with molybdenum disulfide.

8. The bearing of claim 1 wherein the bushing is of oil impregnated sintered bronze.

9. A bearing for use to suspend a shaft within a developer housing in a xerographic device, the bearing comprising:

an annular bushing defining a shaft axis, the bushing having a bearing surface having an inner diameter sized to fit an outer diameter of the shaft, the bushing having an outer periphery sized to fit an aperture in the developer housing, the bushing having an annular sealing shoulder extending axially from the bearing surface; and a seal opposing the sealing shoulder of the bushing, the seal being sized to fit on the shaft for rotation with the shaft with respect to the bushing, the seal having a plurality of sealing lips for contacting the sealing shoulder and defining a stagnation zone between the sealing lips.

10. A modification kit for replacing a shaft within a developer housing of a xerographic device, the kit comprising:

a shaft for rotation within the developer housing, the shaft having a cylindrical end journal;

an annular bushing defining an axis, the bushing having a cylindrical bearing surface having an inner diameter sized to fit an outer diameter of the end journal of the shaft, the bushing having an outer periphery sized to fit an aperture in the developer housing, the bushing having a seal retention shoulder extending axially from the bearing surface; and an annular seal positioned against the seal retention shoulder of the bushing and retained stationary with respect to the bushing by the seal retention shoulder, the seal having a plurality of sealing lips for contacting the end journal of the shall and defining a stagnation zone between the sealing lips.

11. The modification kit of claim 9, wherein the outer circumference of the end journal has a microfinish.

12. The modification kit of claim 9, wherein the shaft is of non-magnetic stainless steel.

13. The modification kit of claim 9, wherein the shaft is for an auger assembly.

14. The modification kit of claim 9, wherein the shaft is for a paddle assembly.

15. The modification kit of claim 9, wherein the shaft is for a paddle assembly and has a second cylindrical end journal, further comprising:

a paddle assembly attached to the shaft;

a second shaft for rotation within the developer housing, the second shaft having a third cylindrical end journal and a fourth cylindrical end journal;

an auger assembly attached to the second shaft;

a second annular bushing, a third annular bushing and a fourth annular bushing, each of the bushings defining an axis, each of the bushings having a cylindrical bearing surface having an inner diameter sized to fit an outer diameter of a respective end journal, each of the bushings having an outer periphery sized to fit an aperture in the developer housing, each of the bushing having a seal retention shoulder extending axially from the bearing surface; and a second annular seal, a third annular seal and a fourth annular seal, each of the seals positioned against the seal retention shoulder of the respective bushing and retained stationary with respect to the respective bushing by the seal retention shoulder, each of the seals having a plurality of sealing lips for contacting the respective end journal and defining a stagnation zone between the sealing lips.

16. A developer unit for a xerographic device comprising:

a developer housing defining a chamber for containing developer;

a shaft for rotation within the developer housing, the shaft having a cylindrical end journal;

an annular bushing defining an axis, the bushing having a cylindrical bearing surface having an inner diameter sized to fit an outer diameter of the end journal of the shaft, the bushing having an outer periphery sized to fit an aperture in the developer housing, the bushing having a seal retention shoulder extending axially from the bearing surface; and an annular seal positioned against the seal retention shoulder of the bushing and retained stationary with respect to the bushing by the seal retention shoulder, the seal having a plurality of sealing lips for contacting the end journal of the shaft and defining a stagnation zone between the sealing lips.

* * * * *

UNITED STATES PATENT AND TRADEMARK OFFICE

CERTIFICATE OF CORRECTION

PATENT NO. : 5,541,710

DATED : JULY 30, 1996

INVENTOR(S) : DANIEL A. STEWART, PAUL A. MARTINSON

It is certified that error appears in the above-indentified patent and that said Letters Patent is hereby corrected as shown below:

Col. 4, line 6, delete "shalt", insert --shaft--

Col. 4, line 19, delete "shalt", insert --shaft--

Col. 8, line 7, delete "shall", insert --shaft--

Signed and Sealed this

Nineteenth Day of November, 1996

Bruce Lehman

*Attest:*

BRUCE LEHMAN

*Attesting Officer*

*Commissioner of Patents and Trademarks*